US012467208B2

(12) United States Patent
Brunninger

(10) Patent No.: US 12,467,208 B2
(45) Date of Patent: Nov. 11, 2025

(54) TRACK MAINTENANCE MACHINE WITH A CONVEYOR OR EXCAVATING CHAIN ARRANGEMENT

(71) Applicant: Plasser & Theurer Export von Bahnbaumaschinen Gesellschaft m.b.H., Vienna (AT)

(72) Inventor: Manfred Brunninger, Altenberg (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 693 days.

(21) Appl. No.: 17/795,627

(22) PCT Filed: Feb. 12, 2021

(86) PCT No.: PCT/EP2021/053407
§ 371 (c)(1),
(2) Date: Jul. 27, 2022

(87) PCT Pub. No.: WO2021/180417
PCT Pub. Date: Sep. 16, 2021

(65) Prior Publication Data

US 2023/0069281 A1 Mar. 2, 2023

(30) Foreign Application Priority Data

Mar. 11, 2020 (AT) ..... A 00057/2020

(51) Int. Cl.
*E01B 27/04* (2006.01)
*E01B 27/02* (2006.01)

(52) U.S. Cl.
CPC ..... *E01B 27/04* (2013.01); *E01B 27/021* (2013.01); *E01B 27/026* (2013.01)

(58) Field of Classification Search
CPC ..... E01B 27/00; E01B 27/021; E01B 27/026; E01B 27/04; E01B 27/06; E01B 27/10;
(Continued)

(56) References Cited

U.S. PATENT DOCUMENTS 3,850,251 A * 11/1974 Plasser ..... E01B 27/10 37/104
4,014,389 A 3/1977 Theurer et al.
(Continued)

FOREIGN PATENT DOCUMENTS

AT 353307 B 11/1979
AT 377551 B 4/1985
(Continued)

OTHER PUBLICATIONS

WO_2013178114-A2 (Year: 2013).*
(Continued)

*Primary Examiner* — Christopher J Sebesta
*Assistant Examiner* — Evan A Bregel
(74) *Attorney, Agent, or Firm* — Collard & Roe, P.C.

(57) ABSTRACT

A track maintenance machine with a conveyor or excavating chain arrangement for removing and collecting railway ballast and/or other formation or substructure layers of a track structure is shown, comprising a cutter bar which can be positioned below a track and which has at least two bar elements, each adjustable in position and alignment, and which is attached to an ascent channel and to a return channel. The device comprises a guided excavating chain consisting of a plurality of chain links, wherein the arrangement can be fastened to a machine frame via at least one height-adjustable suspension device. The excavating chain is designed to be divisible, that the bar elements can be connected via a coupling to form a closed overall unit, and that the arrangement can be variably adjusted in its exca-
(Continued)

vating working width by adjusting the position of the bar elements.

12 Claims, 2 Drawing Sheets

(58) Field of Classification Search
CPC .. E01B 27/105; E01B 27/107; E01B 2203/00; E01B 2203/022; E01B 2203/024; E01B 2203/047; E01B 2203/10
USPC ..... 37/104, 107, 462, 463, 465
See application file for complete search history.

(56) References Cited

U.S. PATENT DOCUMENTS

| | | | | |
|---|---|---|---|---|
| 4,355,687 | A | 10/1982 | Theurer et al. | |
| 4,614,238 | A * | 9/1986 | Theurer | E01B 27/105 104/2 |
| 5,271,166 | A | 12/1993 | Theuer | |
| 6,981,556 | B2 | 1/2006 | Theurer et al. | |

FOREIGN PATENT DOCUMENTS

| | | | | |
|---|---|---|---|---|
| AT | 006 487 | U2 | 11/2003 | |
| CN | 2830485 | Y | 10/2006 | |
| DE | 2057248 | A1 | 6/1971 | |
| DE | 2322518 | A1 | 4/1974 | |
| DE | 30 36 007 | A1 | 6/1981 | |
| EP | 0538760 | A1 * | 10/1992 | E01B 27/10 |
| EP | 0538760 | B1 | 7/1994 | |
| EP | 2631361 | A2 | 8/2013 | |
| GB | 1304900 | A | 1/1973 | |
| GB | 2063971 | A * | 6/1981 | E01B 27/02 |
| RU | 2128755 | C1 | 4/1999 | |
| SU | 1122233 | A3 | 10/1984 | |
| WO | WO-2013179114 | A2 * | 12/2013 | E01B 27/105 |

OTHER PUBLICATIONS

International Search Report in PCT/EP2021/053407 dated May 4, 2021.
Austrian Search Report in Austrian Application No. A 57/2020 dated Nov. 27, 2020.
Russian Search Report in Russian Application No. 2022121353 dated Feb. 15, 2023 with German and English translations.

* cited by examiner

TRACK MAINTENANCE MACHINE WITH A CONVEYOR OR EXCAVATING CHAIN ARRANGEMENT

CROSS REFERENCE TO RELATED APPLICATIONS

This application is the National Stage of PCT/EP2021/053407 filed on Feb. 12, 2021, which claims priority under 35 U.S.C. § 119 of Austrian Application No. A 00057/2020, filed on Mar. 11, 2020, the disclosure of which is incorporated by reference. The international application under PCT article 21(2) was not published in English.

FIELD OF TECHNOLOGY

The invention relates to a track maintenance machine with a conveyor or excavating chain arrangement for removing and collecting railway ballast and/or other formation or substructure layers of a track structure, comprising a cutter bar which can be positioned below a track and which has at least two bar elements, each adjustable in position and alignment, and which is attached on the one hand to an ascent channel and on the other hand to a return channel, furthermore comprising a guided excavating chain consisting of a plurality of chain links, wherein the arrangement can be fastened to a machine frame by means of at least one height-adjustable suspension device. The invention additionally relates to a method for operating the device.

PRIOR ART

The individual system components, from the rail and the sleepers to the ballast bed and the subsoil, are the building blocks of the track structure, and the quality of the ballast bed is one of the determining factors for the quality of the overall system. It has a number of important tasks to fulfil; one of the most important prerequisites is the cleanliness of the ballast.

The optimal track design (ballast quality, formation, track benches, etc.) has a positive effect on drainage, fouling and quality progression.

The causes of ballast fouling are the chipping and abrasion of the ballast stones under operational load, rising material from the subsoil when the filtering effect is inadequate as well as falling loads such as coal, minerals, ore, or leaf fall and wild weed growth on the tracks. Only a maintenance strategy with demand-based ballast cleaning provides a remedy.

A ballast bed that contains too many fine particles can no longer fulfil the essential requirements: its bearing capacity and elasticity are reduced, surface water can no longer drain off freely, the track geometry deteriorates rapidly.

When this point has been reached, it is time for ballast bed cleaning. Nowadays, the same requirements are placed on it as, for example, on tamping machine operations: short track possessions, high throughput, high quality and, if possible, the ability to travel on the track immediately after the end of the work without restricting the permissible speed.

Neglected ballast bed cleaning can result in high maintenance costs, cause speed restrictions, and reduce the service life of the track material—the resulting costs frequently become out of control. For instance, if it becomes necessary to impose speed restrictions in order to maintain safe railway operations, or if full track closures are required for a quick, unforeseen exchange of ballast.

An additional significant cost factor is the ballast material itself. The better the ballast cleaning is, the more the amount of reusable ballast increases. This saves large amounts of material and reduces not only the material costs but also the logistical effort for transporting material and disposal. In addition, stricter environmental protection requirements for track maintenance operations demand that the existing material be reprocessed and reinstalled.

With excavating chains, a general distinction must be made between designs with one degree of freedom and those with two degrees of freedom, often also called cardan chains. A subdivision is made furthermore into ballast chains with smaller excavating teeth, usually equipped with three to five teeth, as well as into much heavier, solidly constructed formation chains with large excavating teeth, which are also used for excavator buckets, among other things.

A conveyor or excavating chain arrangement with an excavating chain with at least two axes running vertically to one another, swivelably or rotatably connected chain links, also referred to as universal joints or cardan joints (2 degrees of freedom), is known from AT 377551 B. The design with cardan joints is necessary because the chain as well as the conveyor channel is bent or deflected in the lower transition area towards the cutter/cross bar in a direction approximately parallel to the track plane. Furthermore, in addition to universal/cardan joints, the use of ball joints is also possible.

EP 0538760 B1 describes a conveyor or excavating chain arrangement in which two separately designed cutter bars are provided, each forming an independent excavating unit with its own height- and transverse-adjustable drives, each excavating unit being assigned an endless excavating chain with a chain drive and two chain guideways located on the same longitudinal side of the machine.

SUMMARY OF THE INVENTION

The object of the invention is to provide a track maintenance machine of the kind mentioned above with a significant improvement in handling during the set-up, installation, and positioning of the device prior to the start of the actual track maintenance operation as well as during dismantling at the end of the construction operation compared to prior art. Handling by a working staff is also to be made much easier.

According to the invention, these objects are achieved by way of a machine according to claim 1 and a method according to claim 10. Dependent claims refer to advantageous embodiments of the invention.

The invention provides that the excavating chain is designed to be divisible, that the bar elements can be connected via a coupling to form a closed overall unit, and that the arrangement can be variably adjusted in its excavating working width by adjusting the position of the bar elements. The excavating chain is responsible both for removing material and for collecting and conveying railway ballast and/or other formation or substructure layers of a track structure. Optimised, faster processes, also supported by drives, reduce machine set-up time and increase economic efficiency.

At maximum excavating width, the rotating excavating chain together with the elements of the cutter bar forms a straight line in the working area below the track; at reduced excavating width, in the plan view, a trapezoidal geometry is produced as an excavating chain contour through the locking/coupling point of the cutter bar moving forward in the working direction. The length of the excavating chain thus remains unchanged. The divisibility of the excavating chain allows for a short set-up time when setting up and preparing for the upcoming work.

It is particularly advantageous if the division of the excavating chain by means of a locking flange is designed as a detachable, mechanical connection with at least one mechanical, detachable connecting element.

The divisibility of the excavating chain via a locking flange in combination with a mechanical, detachable connecting element enables much easier handling with less force required for the operating staff.

It is advantageous if the excavating chain has connecting links arranged between the individual chain links with two degrees of freedom of movement from two axes of rotation crossing in their lines of action.

If the individual links of the excavating chain are designed with two axes of movement, an inclination/deflection of the conveyor channels, i.e. an ascent channel and a return channel, in the lower transition area towards the cutter bar in a direction approximately parallel to the track plane is made possible.

One embodiment of the invention provides that the coupling for connecting the bar elements comprises mechanical fixing elements, the handling of which is carried out manually by a machine operator.

This provides the greatest flexibility during work with full freedom of decision by the operators. The fixing element is advantageously a hook-shaped locking element that locks into a predetermined fixing position.

In a further development, it is provided that the coupling for connecting the bar elements is coupled with a control and regulation system and corresponding measuring equipment as well as sensors for determining position and alignment in order to carry out a fully automatic or semi-automatic actuation of the coupling process.

Expanding the device to include modern electronics and sensors enables efficient operation of the track maintenance machine with a high level of cost effectiveness, and there is also a significant unburdening of the operating staff.

An important feature is also given by the fact that the coupling comprises at least one mechanical, detachable connecting element for connecting the bar elements.

This provides a secure, durable, and robust connection to a closed cutter bar forming a unit after the coupling process.

One design provides that the mechanical connection of the bar elements by means of a coupling is positive through at least one bolt connection.

This represents a particularly robust and stable form of connection with regard to weather influences and/or dirt.

A construction is also possible in which the mechanical connection of the bar elements by means of a coupling is non-positive through at least one screw connection.

If special space ratios or other circumstances necessitate it design-wise, the connection can also be made as a screw connection. In a further embodiment, a combined bolt and screw connection is provided.

Another design provides for a divisible grading bar and at least one variably adjustable and swivelling compaction unit being arranged after the conveyor or excavating chain arrangement.

This further increases the efficiency of the track maintenance machine considerably if, directly after removal of the respective formation or substructure layer and subsequent new installation of cleaned or new material, a clean layer is also produced directly by means of a grading bar and the downstream compaction unit. This is then ready for the new track structure as a result. Furthermore, the divisible design of the grading bar brings great added value due to a short set-up time when setting up and positioning below the track.

The method according to the invention provides that the ascent channel and the return channel are lowered into a desired working position and the bar elements are swivelled in under the track, where furthermore the bar elements are connected by means of a coupling to form a closed unit.

This allows for a quick, convenient set-up and putting into operation of the device without requiring the two rails to be separated. The same applies to dismantling/removal after the end of work. Only the sides of the ballast bed and the adjacent slope flanks must be cleared to allow the device to be lowered into the working position by appropriate removal or excavation. Additionally, after the end of work this also makes the closing and restoration of the rails through time-consuming and costly welding obsolete.

In an advantageous further development of the method, before the start of work the bar elements are connected fully automatically or semi-automatically by means of a control and regulation system with the aid of corresponding measuring equipment as well as sensors for determining position and alignment by means of the coupling.

This offers a high degree of automation with low staff costs. Human intervention is not required, but if necessary manual correction or intervention can be made at any time.

In another design of the method, it is indicated furthermore that the coupling for connecting the bar elements is manually actuated by handling of a machine operator.

As a result, this gives the machine operator full flexibility. Even in the event of malfunctions or defects in the measuring equipment, sensors, or control and regulation system, manual operation ensures that work can continue.

A further realisation of the method enables the cutter bar of the device to be guided in its position and alignment in a controlled manner by corresponding control of the height-adjustable suspension device with the aid of a control and regulation system as well as corresponding measuring equipment and sensors, according to the machine operator's specifications.

This enables the machine operator to achieve the greatest possible precision and quality in the removal of the respective formation or substructure layer. A continuously changing depth geometry of the layer structure and/or change in position of the track maintenance machine is specifically counteracted.

BRIEF DESCRIPTION OF THE DRAWINGS

In the following, the invention is explained by way of example with reference to the accompanying figures. The following figures show in schematic illustrations.

DESCRIPTION OF THE EMBODIMENTS

Figure 1:
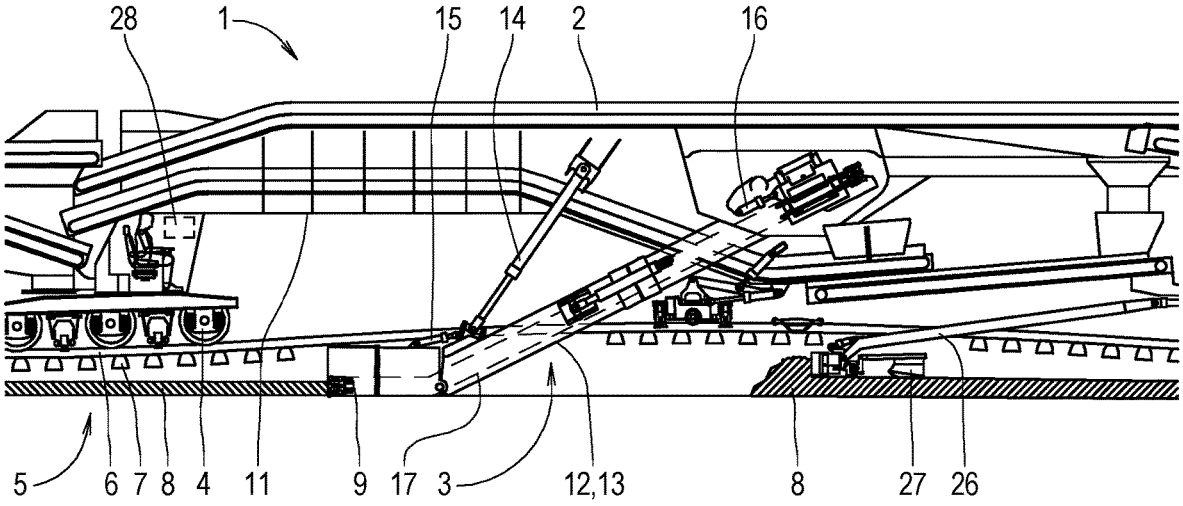
FIG. 1 Side view of a track maintenance machine with a conveyor or excavating chain arrangement for removing and collecting track maintenance material FIG. 2 Top view of the conveyor or excavating chain arrangement with bar elements connected to form a closed unit (top) and open, unconnected bar elements (bottom)

FIG. 1 shows a schematically depicted track maintenance machine 1 with a conveyor or excavating chain arrangement 3 mounted on a machine frame 2, which can be moved along a track 5 by means of rail-based running gears 4. This arrangement comprises a cutter bar 9 which can be positioned below the track 5 and which has two bar elements 10 and a coupling 11. The bar elements 10 are each designed to be adjustable in their position and alignment, attached on the one hand to an ascent channel 12 and on the other hand to a return channel 13. The ascent channel 12 and the return channel 13 are movably mounted on the machine frame 2 via a joint, are displaceable in their position, and can also be swivelled in alignment. Furthermore, an excavating chain 17 is guided over the cutter bar 9 and the adjacent channel parts 12, 13.

The device 3 is connected to the machine frame 2 by means of a height-adjustable suspension device, designed as a hydraulic actuator 14. An inclination control of the cutter bar 9 and thus also the alignment of the excavating chain 17 is carried out via two hydraulic actuators 15, which in the case of the ascent channel 12 as well as the return channel 13 are connected to the respective channel ends adjoining at the bottom, flattening into the horizontal track plane. A chain tensioning device 16 takes over the necessary pre-tensioning of the excavating chain 17. Furthermore, a control and regulation system 28 is mounted in a protected area on the machine frame 2 or in a cab.

A divisible grading bar 26 is hinged to the machine frame 2 via a supporting frame structure. In addition, several distributed compaction/vibrating devices 27, which can be displaced or swivelled in their position and orientation, are combined and connected downstream.

Figure 2:
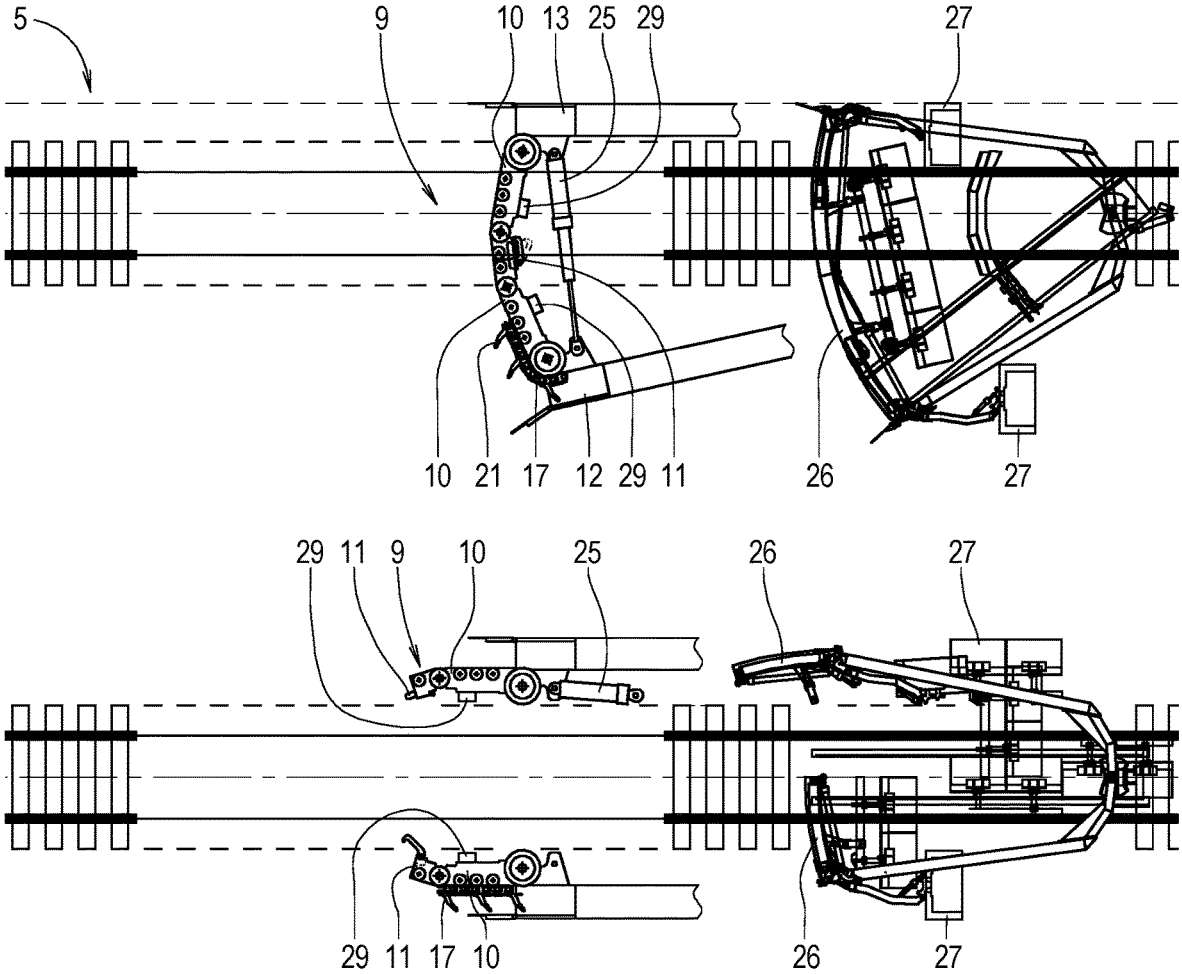

FIG. 2 shows a top view of the device 3 already shown in FIG. 1, with the cutter bar 9 shown as a closed unit in the working position (top) as well as with the coupling 11 open and the bar elements 10, not swivelled in, in the running position (bottom). The divisible excavating chain 17 including excavating teeth 21 is only drawn in a short section for a better overview. In this constructive embodiment, the excavating width of the device 3 can be variably adjusted by means of a hydraulic adjustment actuator 25. The bar elements 10 are equipped with measuring equipment and sensors 29 to supply the control and regulation system 28.

Analogous to the cutter bar 9, the divisible grading bar 26 is also shown as a closed unit in the upper view, while at the bottom the elements of the grading bar 26 are open and the supporting frame structure is swivelled in towards the machine frame 2. The compaction/vibrating devices 27 are also arranged here in a correspondingly swivelled-in position.

The hydraulic adjustment actuator 25 for adjusting the excavating width is detached from the ascent channel 12 in the running position and folded onto the return channel 13. When the cutter bar 9 is divided, the adjustment actuator 25 is released on one side and swivelled outwards. In this position, the adjustment actuator 25 is lowered into an excavating plane together with the bar elements 10 next to the rails during set-up.

For adjustability, each bar element 10 consists of at least two sections that can be swivelled towards each other in the excavating plane by means of a joint during work. In the variant shown, each bar element 10 consists of a longer and a shorter section. The respective longer section is hinged to the adjacent channel part 12, 13. The associated elements of the coupling 11 are arranged on the respective shorter section. When the coupling 11 is closed, the two shorter sections form a rigid unit. The geometrical structure then corresponds to a double rocker mechanism, with the rigid unit as the coupler and the longer sections of the bar elements 10 as the rocker mechanisms. The bearing points of the double rocker mechanism are formed by the connecting joints with the adjacent channel parts 12, 13. These connecting joints can be adjusted in relation to each other by means of the adjustment actuator 25, whereby the excavating width can be adjusted.

In the example shown, the coupling 11 comprises a bolt connection and a swivelling hook as a mechanical fixing element. Specifically, a bolt is arranged on the shorter section of the one bar element 10. As a counter element, a bore is formed in the shorter section of the other bar element 10 to receive the bolt. When the coupling 11 is closed, the bolt, which is seated backlash-free in the bore, causes a rigid connection of the bar elements 10. The coupling connection is fixed by means of the hook, which is swivelably arranged on a bar element 10. In the swivelled-in state, an extension of the hook engages in a counter element of the other bar element 10, whereby the connection is securely closed.

Figure 3:
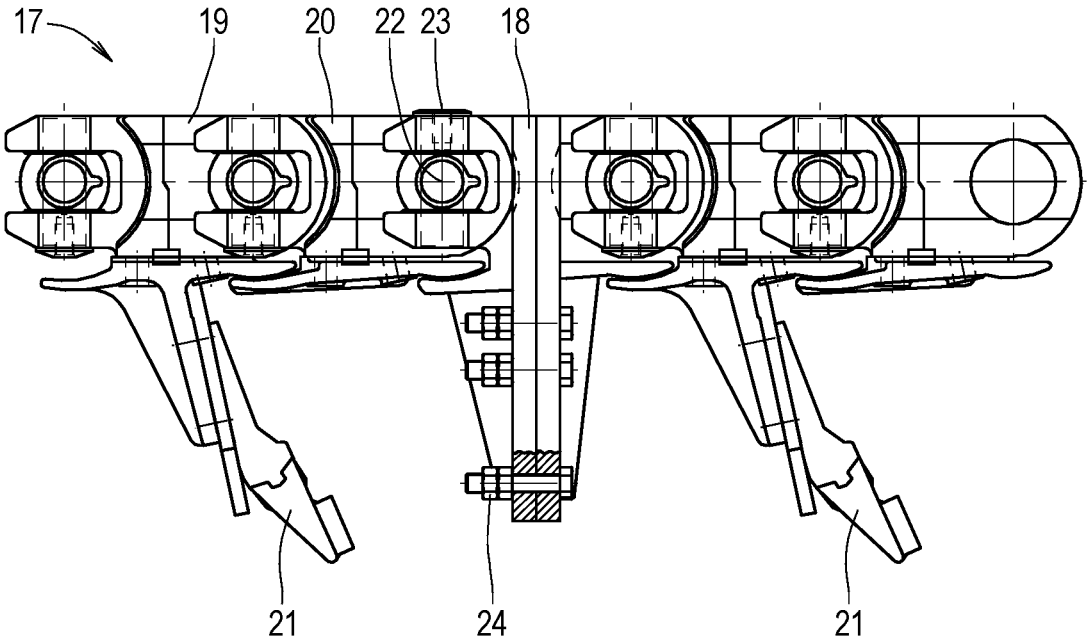
FIG. 3 Section of a divisible excavating chain

FIG. 3 shows an enlarged view of the divisible excavating chain 17, which comprises a locking flange 18, chain links 19, and connecting links 20. Each chain link 19 is directly connected to an excavating tooth 21, which is reinforced against wear and is designed as a solid single tooth in this embodiment. One chain link 19 and one connecting link 20 are connected by means of an intermediate piece. This intermediate piece creates two intersecting axes that are normal to each other. These are the $1^{st}$ axis of rotation 22 and the $2^{nd}$ axis of rotation 23, resulting in two degrees of freedom of movement. The principle is identical to that of a universal joint, also referred to as a cardan joint. The locking flange 18 is now installed between a chain link 19 and a connecting link 20, the two halves of which are screwed together by means of three detachable connecting elements 24.

Figure 4:
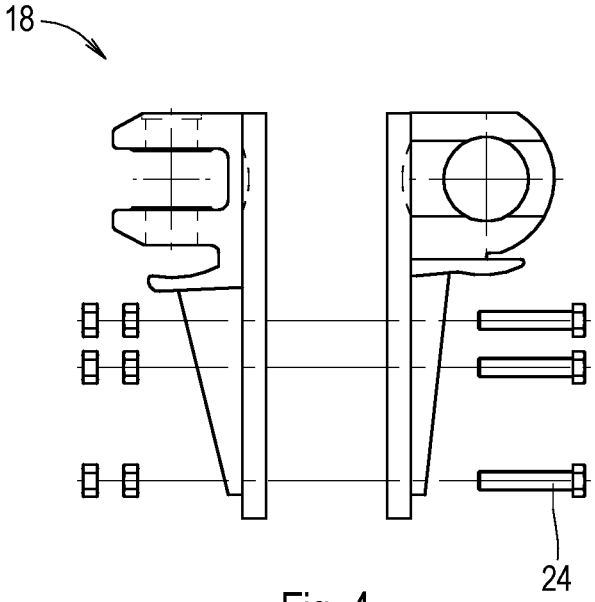
FIG. 4 Detail of the locking flange of a divisible excavating chain

FIG. 4 shows the extracted locking flange 18 of the divisible excavating chain 17 as an illustration of FIG. 3. The locking flange 18 consists of two flange halves and connects the open excavating chain 17 to a closed unit. The three detachable connecting elements 24 are designed as a bolted joint with two hexagon nuts each.

The invention claimed is:

1. A track maintenance machine with a conveyor or excavating chain arrangement for removing and collecting railway ballast and/or other formation or substructure layers of a track structure, comprising:

a machine frame (2);

an ascent channel (12);

a return channel (13) wherein said ascent channel and said return channel are coupled to said machine frame;

a cutter bar (9) which can be positioned below a track and which has at least two bar elements (10), each adjustable in position and alignment, and which is attached to said ascent channel (12) and to said return channel (13), a height adjustable suspension device (14) coupled to the machine frame;

a coupling (11);

a guided excavating chain (17) coupled to the machine frame and consisting of a plurality of chain links, wherein the arrangement can be fastened to said machine frame via said height-adjustable suspension device (14), wherein the guided excavating chain is designed to be divisible, in that the bar elements can be connected via said coupling to form a closed overall unit, and in that the arrangement can be variably adjusted in its excavating working width by adjusting the position of the bar elements, wherein the coupling for connecting the bar elements is coupled with a control and regulation system (28) and corresponding measuring equipment as well as sensors for determining position and alignment in order to carry out a fully automatic or semi-automatic actuation of the coupling process.

2. The track maintenance machine according to claim 1, wherein the division of the excavating chain by means of a locking flange is designed as a detachable, mechanical connection with at least one mechanical, detachable connecting element.

3. The track maintenance machine according to claim 1, wherein the excavating chain comprises connecting links arranged between the individual chain links and having two degrees of freedom of movement from two axes of rotation crossing in their lines of action.

4. The track maintenance machine according to claim 1, wherein the coupling for connecting the bar elements comprises mechanical fixing elements which are manually handled by a machine operator.

5. The track construction machine according to claim 1, wherein the coupling for connecting the bar elements comprises at least one mechanical, detachable connecting element.

6. The track maintenance machine according to claim 5, wherein the mechanical connection of the bar elements by means of a coupling is through at least one bolt connection.

7. The track maintenance machine according to claim 5, wherein the mechanical connection of the bar elements by means of a coupling is via at least one screw connection.

8. The track maintenance machine according to claim 1, wherein a divisible grading bar and at least one variably adjustable and pivoting compaction unit are arranged after the conveyor or excavating chain arrangement.

9. A method of operating a track maintenance machine according to claim 1, wherein the ascent channel and the return channel are lowered into a desired working position and the bar elements are pivoted in under the track, and in that furthermore the bar elements are connected by means of a coupling to form a closed unit.

10. The method according to claim 9, wherein before the start of work the bar elements are connected fully automatically or semi-automatically by means of a control and regulation system with the aid of corresponding measuring equipment as well as sensors for determining position and alignment by means of the coupling.

11. The method according to claim 9, wherein the coupling for connecting the bar elements is manually actuated by handling of a machine operator.

12. The method according to claim 9, wherein one the cutter bar of the device is guided in its position and alignment in a controlled manner by corresponding control of the height-adjustable suspension device with the aid of a control and regulating system as well as corresponding measuring equipment and sensors, according to the machine operator's specifications.

* * * * *